US007244154B1

(12) United States Patent
Connell

(10) Patent No.: US 7,244,154 B1
(45) Date of Patent: Jul. 17, 2007

(54) SINGLE AND MULTI-ENGINE DRIVE SYSTEM FOR A TWIN SCREW VESSEL

(76) Inventor: Calvin C. Connell, 132 Lakeshore Dr., Apt 917, North Palm Beach, FL (US) 33408

( * ) Notice: Subject to any disclaimer, the term of this patent is extended or adjusted under 35 U.S.C. 154(b) by 0 days.

(21) Appl. No.: 11/506,658

(22) Filed: Aug. 19, 2006

(51) Int. Cl.
*B63H 20/16* (2006.01)
*B63H 21/21* (2006.01)

(52) U.S. Cl. ..... 440/75; 440/86

(58) Field of Classification Search ..... 440/75
See application file for complete search history.

(56) References Cited

U.S. PATENT DOCUMENTS 1,781,656 A * 11/1930 Day ..... 440/4
2,155,434 A * 4/1939 Marsh ..... 74/661
3,422,790 A * 1/1969 Connell ..... 440/4
4,344,760 A * 8/1982 Kulikowski ..... 440/3

* cited by examiner

*Primary Examiner*—Jesús D. Sotelo
(74) *Attorney, Agent, or Firm*—Robert M. Downey, PA

(57) ABSTRACT

In a twin screw marine vessel that has two engines arranged in tandem along the vessel's centerline, a drive system allows both engines to drive the propellers or, alternatively, either engine to drive both propellers independently (e.g. one in forward, the other in reverse) while the other engine is disengaged and shut down. The output of each engine engages and disengages with one of two chain drives with the use of a clutch. A third clutch is provided between the two chain drives for selectively engaging and disengaging the chain drives with one another. An under/overdrive unit on the output of each chain drive is linked to a respective port or starboard V-drive via a universal drive shaft. Each V-drive has an internal transmission for selective clockwise or counter clockwise rotation of a correspondingly driven one of the port and starboard propellers. The under/overdrive units allow for a change in gear ratio between single engine and twin engine drive for maximum efficiency.

10 Claims, 2 Drawing Sheets

SINGLE AND MULTI-ENGINE DRIVE SYSTEM FOR A TWIN SCREW VESSEL

BACKGROUND OF THE INVENTION

1. Field of the Invention

This invention relates to drive systems on multi-engine marine vessels and, more particularly, to a drive system on a twin screw marine vessel that allows both engines or, alternatively, either engine to individually operate both propellers.

2. Discussion of the Related Art

Conventional motor driven boats often use two or more engines, wherein each engine is adapted to drive a single propeller. The use of twin screws, wherein one propeller is on the port side of the boat's centerline and the other propeller is on the starboard side of the boat's centerline, allows for easy maneuvering and turning of the boat at low speeds when the boats rudders have minimal affect. The use of twin screws is particularly useful when docking and maneuvering a boat in tight areas (e.g., a canal or marina).

While there are definite benefits to the use of twin screws in a marine vessel, the need to operate both engines, particularly at low speeds, is highly inefficient. Additionally, if one engine fails, the motor vessel can only operate on a single engine driving a single propeller. In this instance, it is difficult to steer, maneuver and dock the vessel. Moreover, inboard engines are typically mounted in side by side relation in a conventional motor driven boat in order to drive the corresponding port or starboard propeller. This arrangement with each engine offset relative to the centerline of the vessel is not to ideal for lateral stability.

My previous invention, as disclosed in U.S. Pat. No. 3,422,790 places both engines along the centerline of the boat to provide the best dynamic and static center of gravity. In at least one embodiment of my previous invention, two engines, arranged along the longitudinal centerline of a boat are connected to a drive system for driving two propellers. With the use of dog clutches, both engines or, alternatively, either engine, can operate both propellers. This allows for numerous advantages, particularly in the instances of failure to the engine.

Notwithstanding the numerous advantages of my previous invention, the ability to operate the boat on one engine driving twin screws at cruising speeds is problematic. It has since been discovered that a change in the gear reduction ratio when operating twin screws on the single engine allows the boat to obtain higher cruising speeds while operating on the single engine. Changing the gear reduction ratio between single engine operation and twin engine operation has been achieved with the use of under/overdrive units connected to the universal drive shafts for each propeller. Moreover, is has been discovered the use of two chain drives, one for each screw, is optimal in order to selectively operate both screws on twin engines or, alternatively, on either engine independently.

OBJECTS AND ADVANTAGES OF THE INVENTION

It is a primary object of the present invention to provide a drive system on a twin engine marine vessel which reduces the fuel consumption in half by operating the marine vessel with the use of one engine to drive both propellers.

It is a further object of the present invention to provide a drive system on a twin screw marine vessel which is adapted to allow operation of the boat on a single engine to drive both propellers, thereby permitting easy docking and maneuvering while operating only a single engine.

It is still a further object of the present invention to provide a drive system on a multi-engine twin screw vessel that allows both propellers to be driven by either one of two engines, thereby doubling the engine life of both engines.

It is still a further object of the present invention to provide a drive system in a multi-engine twin screw marine vessel, and wherein the drive system is structured and disposed to allow for selective driving of the twin screws with the use of both engines or either engine, independently.

It is still a further object of the present invention to provide a drive system on a multi-engine twin screw vessel which is structured and disposed to permit operation of the vessel at cruising speed while operating one engine to drive the twin propellers, and wherein both engines can be selectively engaged to drive the twin propellers to obtain higher speeds only when necessary or when required to meet an objective in less time.

It is still a further object of the present invention to provide a drive system on a multi-engine twin screw marine vessel, and wherein the engines are arranged in tandem along the centerline of the hull of the marine vessel, thereby providing maximum lateral stability.

These and other objects and advantages of the present invention are more readily apparent with reference to the drawings and detailed description.

SUMMARY OF THE INVENTION

In a marine vessel that has twin screws, a first auto rotation engine and a second auto rotation engine are arranged in tandem along the center line of the vessel. A clutch of the output of each engine enables the selective engagement and disengagement of the horse power of each engine into respective port and starboard power trains. In a preferred embodiment, chain drives are used as the power train. Among other advantages, chain drives provide less horsepower loss between the engine output and propeller compared to gear drives. The forward engine uses a reverse rotation clutch to allow both chain drives to be driven in the same rotational direction. Another clutch allows the chain drives to be selectively engaged and disengaged with each other so that each engine can dependently drive a separate chain drive or, alternatively, one engine can drive both chain drives with the other engine disengaged and shut down.

An under/overdrive unit on the output of each of the chain drives allows for a change in gear ratio between single engine and twin engine drive of both propellers in order to obtain maximum efficiency. The output of each chain drive connects to a V-drive using universal drive shafts. The V-drives have internal forward and reverse transmissions for clockwise and counter-clockwise rotation of the propellers.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
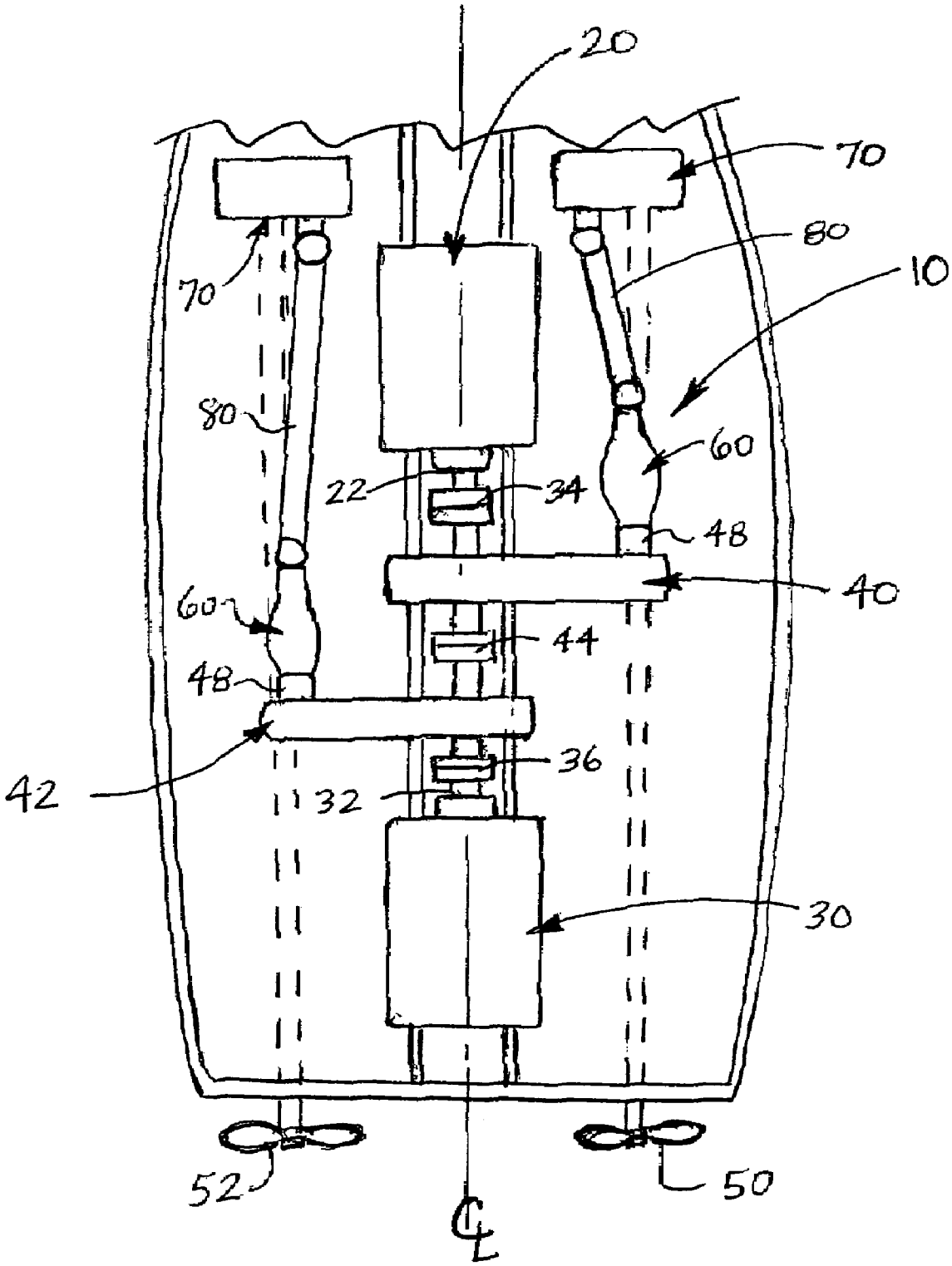
FIG. 1 is a diagrammatic illustration of the drive system of the present invention.
Figure 2:
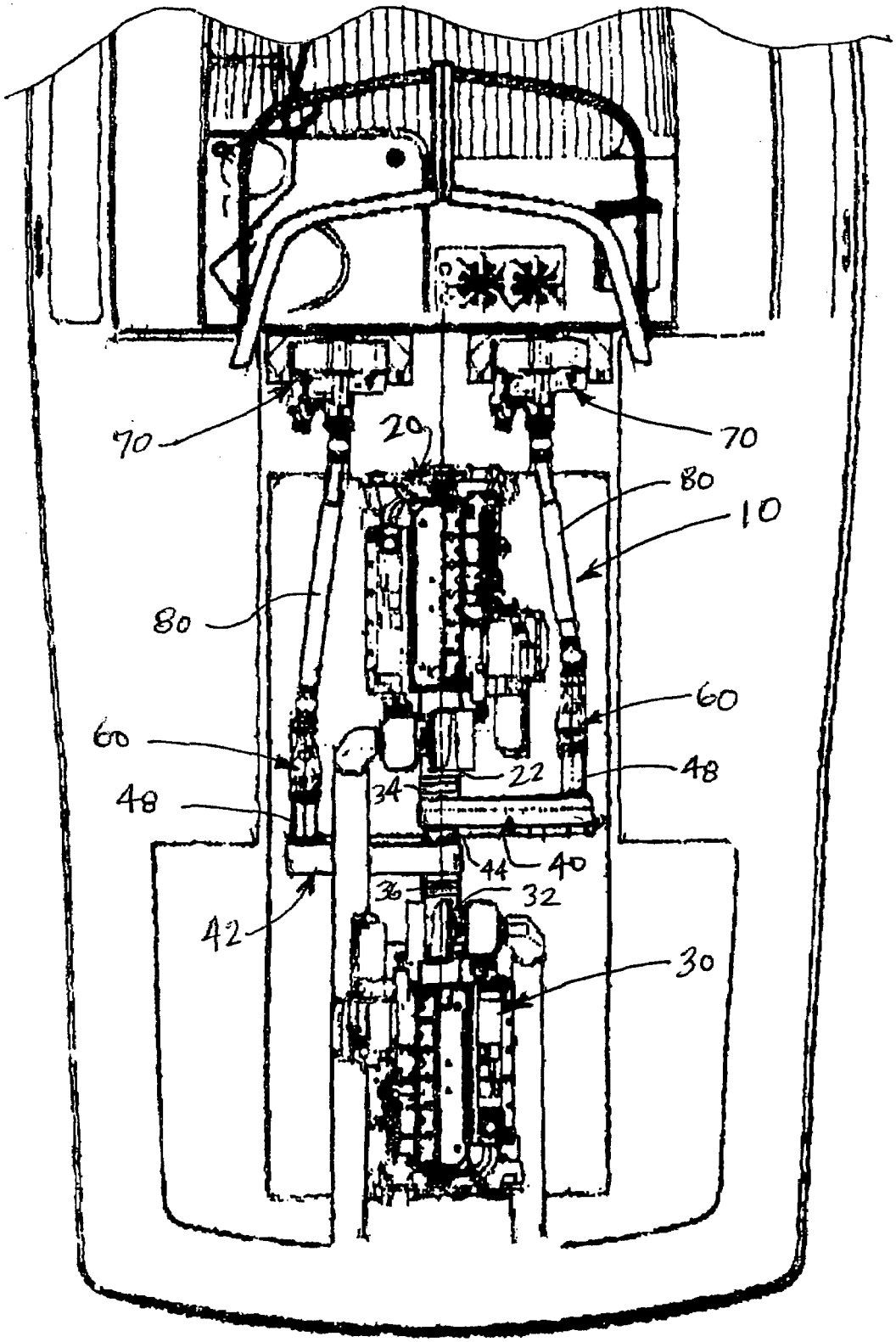
FIG. 2 is a top plan view showing two engines mounted in tandem along the centerline of a marine vessel and with the drive system of the present invention installed.

The drive system of the present invention is shown in FIGS. 1 and 2 and is referred to generally as 10.

According to the invention, two auto rotation engines are installed in tandem along the longitudinal centerline of a motor driven boat. A forward engine 20 has its output 22 facing aft, while the rear engine 30 has its output 32 facing forward. On the output of the forward engine 20 there is a reverse rotation clutch 34 that allows for engagement and disengagement of the output horsepower of the engine into chain drive 40. The output of the rear engine 30 has a dog clutch 36 that allows for engagement and disengagement of the rear engine 30 into chain drive 42. Specifically, forward engine 20 directly engages chain drive 40 while rear engine 30 directly engages chain drive 42. A third dog clutch 44 is provided between the chain drives that allows for selective engagement and disengagement of the two chain drives 40, 42 with one another. The reverse rotation clutch 34 allows chain drive 40 to be driven in the same direction as chain drive 42. This multiple clutch and chain drive arrangement allows the boat operator to selectively engage both engines 20, 30 with the respective chain drives 40, 42, independently so that the forward engine 20 drives the starboard propeller 50 and the rear engine 30 drives the port propeller 52. The clutch and chain drive arrangement further allows the boat operator to selectively engage and disengage either the forward engine 20 or the rear engine 30 with both chain drives 40, 42 so that either the forward engine 20 or rear engine 30 can drive both propellers 50, 52 while the other engine remains disengaged and shutdown. This allows the boat operator to balance the hours on both engines while operating the boat on a single engine at lower cruising speeds and while docking and maneuvering. Additionally, a single engine can operate both propellers in the event one engine fails.

The output 48 of each chain drive 40, 42 is fitted to an under/overdrive unit 60 that is engaged in its respective drive system, whether running on both engines or on a single engine. When running on one engine, the under/overdrive units 60 are in under drive so as to better balance the reduction ratio for single engine operation. The under/overdrive units 60 are adapted to change the gear ratio for twin engine operation for operating in overdrive for which the propellers were matched in order to obtain maximum efficiency.

A pair of V-drives 70 are mounted port and starboard, with each V-drive linked to a respective under/overdrive unit 60 via interconnecting universal drive shafts 80. Specifically, the input power to the V-drives 70 is achieved by cordon universal drive shafts 80 that require no alignment. The V-drives 70 are provided with internal forward and reverse transmissions that are able to run in full power forward or reverse. The V-drives 70 are specifically adapted to run in clockwise or counter clockwise rotation from input drive shafts 80 in order to maintain counter rotation of the propellers in the forward and reverse modes whether powered by the front engine or the rear engine.

Alignment of both engines along the longitudinal centerline of the boat's hull and, in the case of a deep V-hull at the lowest possible roll center, provides for maximum lateral stability. Further, the inline tandem engine arrangement allows for more convenient engine access and easier engine serviceability.

While the present invention has been shown and described in accordance with a preferred and practical embodiment thereof, it is recognized that departures from the instant disclosure are fully contemplated within the spirit and scope of the invention.

What is claimed is:

1. A drive system in a multi-engine marine vessel having port and starboard propellers, said drive system comprising:

a forward engine mounted along the longitudinal centerline of the vessel and having an output facing aft;

a rear engine mounted along the longitudinal centerline of the vessel, in longitudinal alignment with said forward engine, and having an output facing forward;

a first power train;

a second power train;

first clutch means for selectively engaging and disengaging said forward engine with said first power train;

second clutch means for selectively engaging and disengaging said rear engine with said second power train;

third clutch means for selectively engaging said first power train with said second power train;

a port transmission means for drivingly engaging and rotating the port propeller in forward and reverse operation, and for disengaging the port propeller when operated to neutral;

a starboard transmission means for drivingly engaging and rotating the starboard propeller in forward and reverse operation, and for disengaging the starboard propeller when operated to neutral;

an under/overdrive unit on an output of each of said first and second power trains, and each of said under/overdrive units being drivingly linked to a respective one of said port and starboard transmission means, and said under/overdrive units being structured and disposed for changing and balancing a reduction gear ratio between single engine drive of both of said port and starboard propellers and twin engine drive of said port and starboard propellers.

2. The drive system as recited in claim 1 wherein said first and second power trains are chain drives.

3. The drive system as recited in claim 2 wherein said second clutch means and said third clutch means are dog clutches.

4. The drive system as recited in claim 2 wherein said first clutch means is a reverse rotation clutch.

5. The drive system as recited in claim 1 wherein said port transmission means and said starboard transmission means comprise a pair of V-drives.

6. The drive system as recited in claim 1 wherein said under/overdrive units are structured and disposed to operate in under drive during single engine operation of the port and starboard propellers and, further, wherein said under/overdrive units are structured and disposed to operate in overdrive during twin engine operation of the port and starboard propellers.

7. A drive system in a multi-engine marine vessel having port and starboard propellers, said drive system comprising:

a forward engine mounted along the longitudinal centerline of the vessel and having an output facing aft;

a rear engine mounted along the longitudinal centerline of the vessel, in longitudinal alignment with said forward engine, and having an output facing forward;

a first power train including a chain drive;

a second power train including a chain drive;

first clutch means for selectively engaging and disengaging said forward engine with said first power train and said first clutch means including a reverse rotation clutch for changing direction of drive rotation between said output of said forward engine and said first power train;

second clutch means for selectively engaging and disengaging said rear engine with said second power train;

third clutch means for selectively engaging said first power train with said second power train;

a port transmission means for drivingly engaging and rotating the port propeller in forward and reverse operation, and for disengaging the port propeller when operated to neutral;

a starboard transmission means for drivingly engaging and rotating the starboard propeller in forward and reverse operation, and for disengaging the starboard propeller when operated to neutral;

an under/overdrive unit on an output of each of said first and second power trains, and each of said under/overdrive units being drivingly linked to a respective one of said port and starboard transmission means, and said under/overdrive units being structured and disposed for changing and balancing a reduction gear ratio between single engine drive of both of said port and starboard propellers and twin engine drive of said port and starboard propellers.

8. The drive system as recited in claim 7 wherein said second clutch means and said third clutch means are dog clutches.

9. The drive system as recited in claim 7 wherein said port transmission means and said starboard transmission means comprise a pair of V-drives.

10. The drive system as recited in claim 7 wherein said under/overdrive units are structured and disposed to operate in under drive during single engine operation of the port and starboard propellers and, further, wherein said under/overdrive units are structured and disposed to operate in overdrive during twin engine operation of the port and starboard propellers.

* * * * *